US005662129A

United States Patent [19]

Grenevitch et al.

[11] Patent Number: 5,662,129

[45] Date of Patent: Sep. 2, 1997

[54] EYEBROW TEMPLATE

[76] Inventors: George Grenevitch, 1279 W. Oregon St.; Brenda Lee Sacksteder, 2102 Keeran Dr., both of Lapeer, Mich. 48446; Charles E. Schiedegger, 2848 Galway Bay Dr., Metamora, Mich. 48455

[21] Appl. No.: 639,699

[22] Filed: Apr. 29, 1996

[51] Int. Cl.[6] ..... A45D 40/30

[52] U.S. Cl. ..... 132/319; 132/216; 132/218; 132/320

[58] Field of Search ..... 132/319, 216, 132/218, 320, 285, 286; 2/206; 604/303; 606/130

[56] References Cited

U.S. PATENT DOCUMENTS

| | | | |
|---|---|---|---|
| D. 291,607 | 8/1987 | Flores . | |
| 1,812,425 | 6/1931 | Wosse . | |
| 2,394,799 | 2/1946 | Morley et al. . | |
| 2,435,516 | 2/1948 | Samson . | |
| 2,628,626 | 2/1953 | Teillaud | 132/319 |
| 2,917,058 | 12/1959 | Ferrar . | |
| 2,998,821 | 9/1961 | Hurdel . | |
| 3,557,805 | 1/1971 | Hamada . | |
| 3,718,145 | 2/1973 | Chateau | 132/319 |
| 4,024,879 | 5/1977 | Stryker . | |
| 4,858,631 | 8/1989 | Chaung . | |
| 5,186,190 | 2/1993 | Hirzel | 132/319 |

FOREIGN PATENT DOCUMENTS

| | | | |
|---|---|---|---|
| 941489 | 1/1949 | France | 132/319 |

*Primary Examiner*—Gene Mancene
*Assistant Examiner*—Pedro Philogene
*Attorney, Agent, or Firm*—Harness, Dickey & Pierce, P.L.C.

[57] ABSTRACT

An eyebrow template system which enables the user to symmetrically or asymmetrically shape eyebrows to yield aesthetically pleasing shape and size. The system includes a pair of templates having openings in the desired shape of the simulated eyebrow. A template holder receives each of the pair of templates through a pair of slots, each slot receiving one of the templates. The template holder also is formed with a pair of apertures generally larger than the openings of the pair of templates to enable a user to paint the simulated eyebrows. A fastener then attaches the apparatus for applying simulated eyebrows to the user.

13 Claims, 2 Drawing Sheets

EYEBROW TEMPLATE

BACKGROUND OF THE INVENTION

1. Technical Field

This invention relates generally to an apparatus for application of simulated eyebrows and, more particularly, to a stencil for enabling the correct shape and symmetrical application of the left and right simulated eyebrows.

2. Discussion

It has long been a practice of some women to simulate the appearance of eyebrows using an eyebrow pencil to paint the simulated eyebrows. Many eyebrow pencil users attempt to paint the eyebrow using the pencil in a freehand manner. Such application is problematic for several reasons. First, the user faces a mirror while using the eyebrow pencil to view the application of the painted eyebrow. Facing a mirror enables the user to view the application of the eyebrow, but the user typically must position their hands so that they are able to view the application of the eyebrow in the mirror. Such positioning may be less than desirable for enabling the user to apply aesthetically pleasing and symmetric eyebrows. Second, facing a mirror to apply the simulated eyebrow requires that the user adjust to applying the simulated eyebrow while viewing the mirror image of their face. Tracing the eyebrow in a mirror image often proves difficult because the user may move the eyebrow pencil in a direction opposite the desired direction because the user is viewing a mirror image. Third, it is difficult to obtain the desired shape and symmetry between the left and right eyebrows because the user must employ the eyebrow pencil ambidextrously using both the left and right hands or apply both eyebrows using the same hand. Using the eyebrow stencil with just one hand further increases the difficulty in obtaining symmetry between the left and right eyebrow because the user must reach across their body to apply one eyebrow. Thus, there is a desire to provide a device which overcomes the inherent disadvantages of using an eyebrow pencil to freehand draw symmetric, simulated eyebrows in a relatively easy manner.

Several methods and apparatuses have been developed in an attempt to facilitate the application of symmetric and shapely eyebrows. Examples of such methods and apparatuses may be found with respect to U.S. Pat. No. 5,186,190, Harzel; U.S. Pat. No. 4,858,631, Chuang; U.S. Pat. No. 718,145, Chateau; U.S. Pat. No. 3,557,805, Hamada; U.S. Pat. No. 2,998,821, Hurdel; U.S. Pat. No. 2,917,058, Ferrar; U.S. Pat. No. 2,628,626, Teillaud; U.S. Pat. No. 2,435,516, Samson; and U.S. Pat. No. 1,812,425, Wosse.

Several of the approaches discussed in the above-listed patents involve stencils, but suffer from one or both of the following disadvantages. First, some stencils fail to remain in place independently of the user holding the stencil with one hand while painting the eyebrow with the eyebrow pencil in the other hand. Such an arrangement makes application of the eyebrow relatively uncomfortable on the user. Second, some stencils fail to provide the user with a variety of eyebrow shapes and sizes to choose from. Third, the stencils which do provide the user with a choice in the selection of shapes and sizes of the simulated eyebrow are often not reusable and are relatively cumbersome to use.

Thus, there is a need for an eyebrow stencil which offers the user a variety in the size and/or shapes of the simulated eyebrows to choose from and is relatively easy to use.

SUMMARY OF THE INVENTION

An apparatus for applying simulated eyebrows and including a pair of templates having openings in the desired shape of the simulated eyebrow. A template holder receives each of the pair of templates through a pair of slots, each slot receiving one of the templates. The template holder also is formed with a pair of apertures generally larger than the openings of the pair of templates to enable a user to paint the simulated eyebrows. A fastener then attaches the apparatus for applying simulated eyebrows to the user.

From the subsequent detailed description taken in conjunction with the accompanying drawings and subjoined claims, other objects and advantages of the present invention will become apparent to those skilled in the art.

DETAILED DESCRIPTION OF THE INVENTION

The following description of the preferred embodiments is merely exemplary in nature and not intended to limit the invention or its application or uses. In this invention, note that elements having similar structures or functions will be referred to using like referenced numerals.

Figure 1:
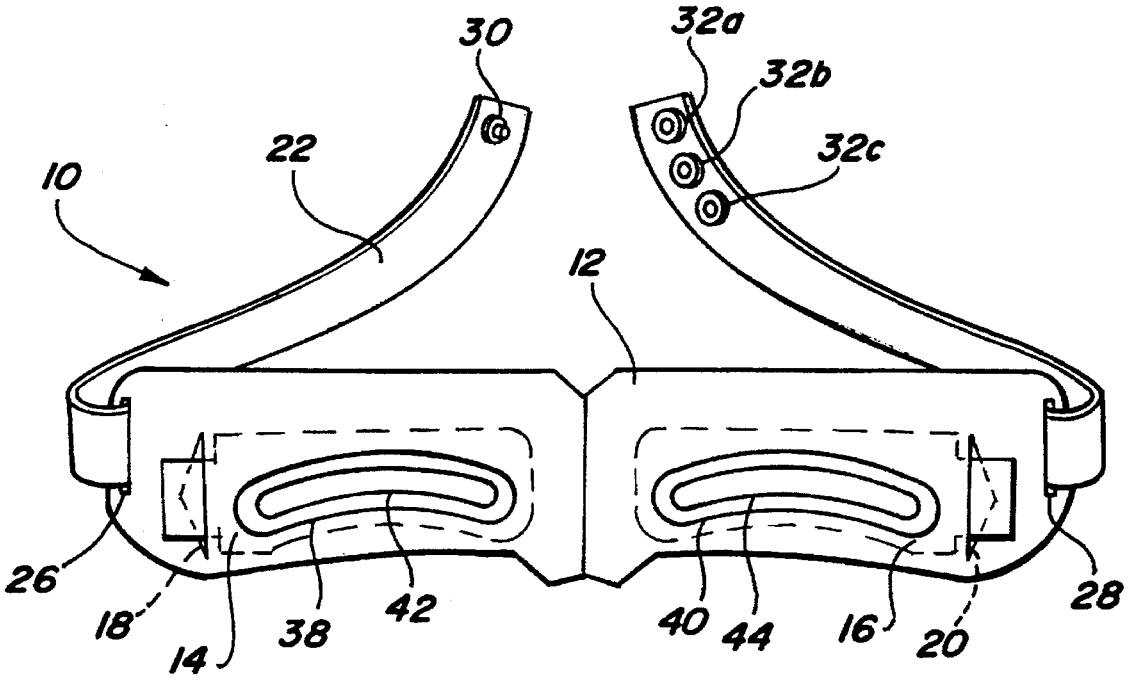
FIG. 1 is a perspective view of the eyebrow template system of the present invention arranged in accordance with the principles of the present invention.
Figure 2:
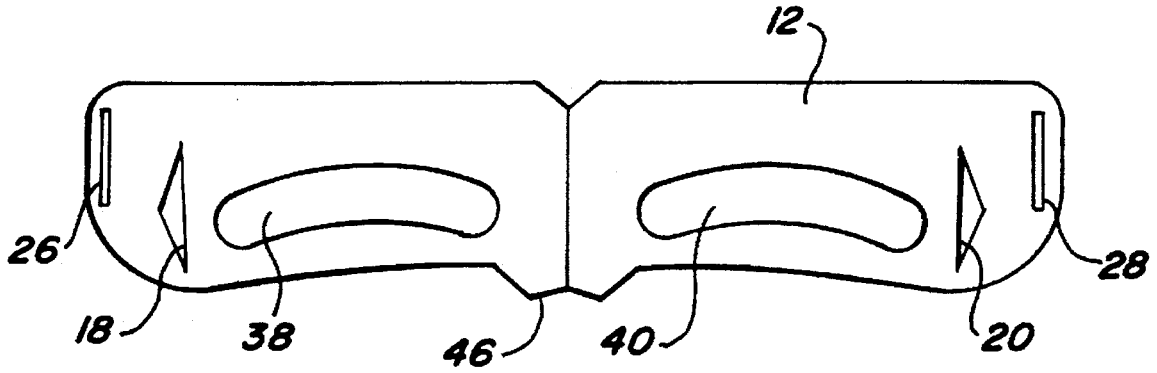
FIG. 2 depicts the template holder for positioning the templates and enabling the exchange of various templates may be interchanged.
Figure 3:
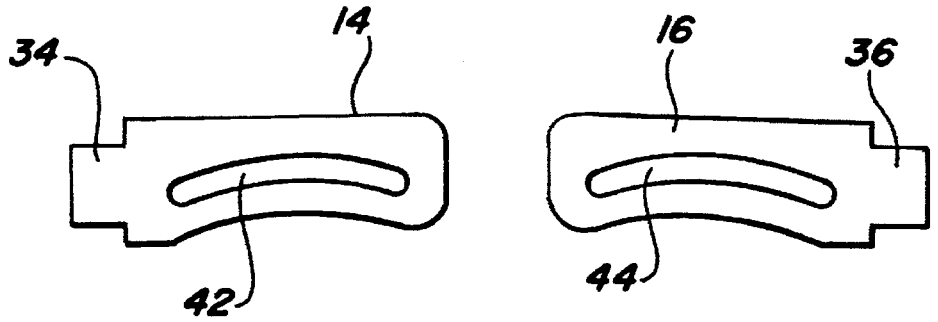
FIG. 3 depicts an example of left and right eyebrow templates for use in the present invention.

Referring to FIGS. 1–3, the eyebrow template system is shown as arranged in accordance with the principles of the present invention. The eyebrow template system 10 includes a template holder 12 into which is inserted a right template 14 and a left template 16 into a pair of slots 18 and 20, respectively. A pair of elastic bands 22 and 24 attach to the template holder 12 by engaging a pair of apertures 26 and 28. The bands 22 and 24 are preferably formed of an elastic material which provides a retaining force to fasten the eyebrow template system 10 in position on the user. The elastic bands 22 and 24 also include a fastening means comprising a snap 30 which engages one of a trio of possible connectors 32*a*, 32*b*, and 32*c*. In this manner, elastic bands 22 and 24 may be adjustable in accordance with the head size of the user to provide a more comfortable fit during application of the eyebrows.

As described above, template holder 12 includes a pair of triangular slots 18 and 20 into which is inserted templates 14 and 16. Templates 14 and 16 are held in place through an interference fit with slots 18 and 20. Templates 14 and 16 also include tabs 34 and 36 which provide a handle by which the user may insert and remove templates 14 and 16 from slots 18 and 20, respectively. Multiple sets of templates 14 and 16 provide the user with various options regarding the size and shape of the stenciled eyebrows. In addition, templates 14 and 16 need not be identical, so that a user may apply eyebrows of differing shapes. Template holder 12 also includes two openings 38 and 40 through which the user may paint the simulated eyebrows using an eyebrow pencil (not shown). Openings 38 and 40 are preferably substantially larger than template openings 42 and 44 which provide the actual guides for the eyebrow pencil so that the user may correctly and accurately stencil the simulated eyebrows using the eyebrow templates 14 and 16. Template holder 12 also includes an arcuate-shaped bridge 46 which rests upon the bridge of the nose of the user to provide support for the eyebrow template 10.

Figure 4:
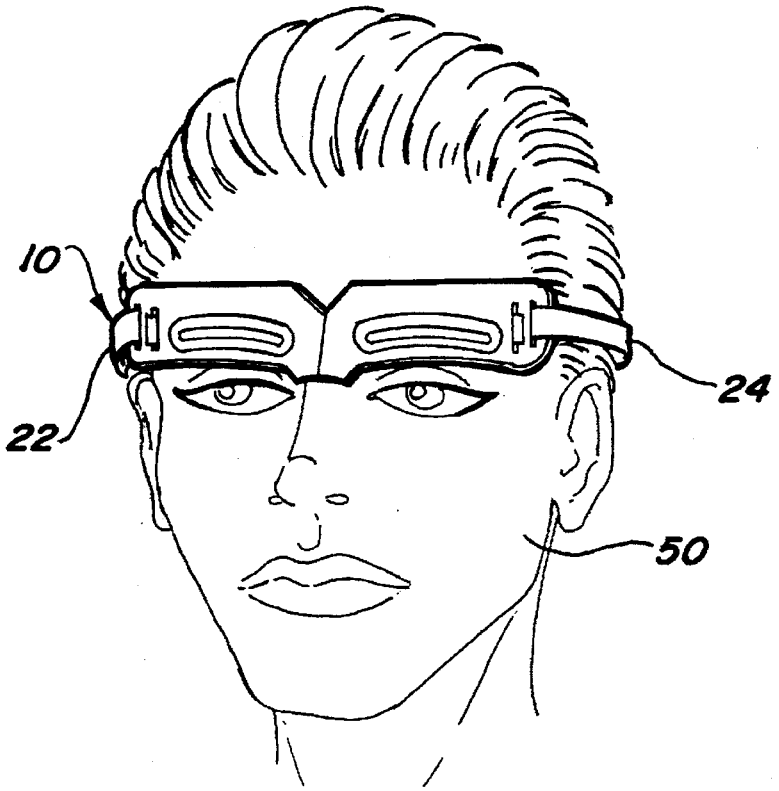
FIG. 4 is a perspective view of the eyebrow template system shown in operation arranged on the face of the user.

Referring to FIG. 4, the eyebrow template 10 is shown in operation on the face 50 of a user. The eyebrow template system 10 is held in place through elastic bands 22 and 24 which are fastened at the back of the head of the user to apply a gentle pressure to maintain the template holder 12 in place. Once the eyebrow template system 10 is held in place, the user can then stencil the simulated eyebrows by tracing within the template openings 42 and 44. after the user has painted within the openings using the eyebrow pencil, the eyebrow template system 10 may then be removed leaving a pair of symmetrical and shapely eyebrows.

Further, the present invention also allows the user to accurately and symmetrically shape natural eyebrows. To shape natural eyebrows, the user would trace the periphery of the template openings 38 and 40, then remove the apparatus and pluck the eyebrow hairs outside of the traced area.

From the foregoing description, it can be seen that the present invention enables the application of eyebrows having particular shares and sizes. Such application may be either symmetric or asymmetric, and is useful for shaping both natural and artificial eyebrows.

While the above detailed description describes the preferred embodiment of the present invention, it will be understood that the present invention is susceptible to modification, variation and alteration without deviating from the scope and fair meaning of the subjoined claims.

What is claimed is:

1. An apparatus for applying simulated eyebrows comprising:

a pair of templates having openings in the desired shapes of the simulated eyebrows;

a template holder for receiving each of the pair of templates, the template holder having a pair of slots for receiving the pair of templates, respectively, the template holder also being formed with a pair of apertures generally larger than the openings of the pair of templates to enable a user to paint the simulated eyebrows; and a fastener for attaching the apparatus for applying simulated eyebrows to the user.

2. The apparatus as defined in claim 1 wherein the slots of the eyebrow template holder and the eyebrow templates are formed so that each eyebrow templates may be interchanged with other eyebrow templates.

3. The apparatus as defined in claim 2 wherein the other eyebrow templates have openings formed to enable the application of simulated eyebrows having shapes other than the first pair of eyebrow templates.

4. The apparatus as defined in claim 1 wherein the template holder further includes a pair of apertures for receiving the fastener.

5. The apparatus as defined in claim 4 wherein the fastener further comprises a pair of elastic bands, a first band engaging a first of the aperture pair and a second band engaging a second of the aperture pair at first ends of the band, the bands being interlocked in proximity to second ends of the bands.

6. The apparatus as defined in claim 5 wherein the first and second bands may be interlocked at one of a plurality of engagement points.

7. The apparatus as defined in claim 1 wherein one of the pair of templates corresponds to a right eyebrow and the other of the pair of templates corresponds to the left eyebrow.

8. An eyebrow template system comprising:

a left eyebrow template;

a right eyebrow template; and an eyebrow template holder for receiving the left and right eyebrow templates, the template holder having a left slot for receiving the left eyebrow template and a right slot for receiving the right eyebrow template, each template being inserted into the respective slot.

9. The system as defined in claim 8 further comprising:

a left and right aperture formed in the template holder;

a left fastener attached to the left aperture of the eyebrow template holder; and a right fastener attached to the right aperture of the eyebrow template holder;

wherein the left and right fasteners attach at ends opposite the template holder to maintain the eyebrow template system in place on a user.

10. The system as defined in claim 9 wherein the left and right fastener are formed of elastic.

11. The system as defined in claim 9 wherein the left and right fasteners attach at one of a plurality of points to vary the tension of the fastener.

12. The system as defined in claim 10 wherein the eyebrow template holder further comprises:

a left opening corresponding to the opening of the left eyebrow template, the left opening being generally larger than the opening of the left template; and a right opening corresponding to the opening of the right eyebrow template, the right opening being generally larger than the opening of the right template.

13. The system described in claim 8 further comprising multiple pairs of eyebrow templates which provide the user with a variety of shapes and sizes.

* * * * *